United States Patent [19]

MacCarthy

[11] Patent Number: 5,024,625

[45] Date of Patent: Jun. 18, 1991

[54] TOP AND PROPELLING ELEMENT

[76] Inventor: Patrick MacCarthy, 5263 Arbutus St., Arvada, Colo. 80002

[21] Appl. No.: 230,090

[22] Filed: Aug. 9, 1988

[51] Int. Cl.[5] ..... A63H 1/02

[52] U.S. Cl. ..... 446/259; 446/178

[58] Field of Search ..... 446/259, 256, 258, 257, 446/260–263, 236; 192/107 M

[56] References Cited

U.S. PATENT DOCUMENTS

| | | | |
|---|---|---|---|
| 3,054,217 | 9/1962 | D'Amato | 446/236 |
| 3,082,574 | 3/1963 | Hellman | 446/259 |
| 3,224,142 | 12/1965 | Pawelka et al. | 446/259 X |
| 3,263,362 | 8/1966 | La Falce | 446/259 |
| 3,591,181 | 7/1971 | Stewart | 446/259 X |
| 3,623,262 | 11/1971 | Noda | 446/259 X |
| 3,654,777 | 4/1972 | Grundman | 192/107 M X |

FOREIGN PATENT DOCUMENTS

| | | | |
|---|---|---|---|
| 623675 | 12/1935 | Fed. Rep. of Germany | 446/259 |

*Primary Examiner*—Mickey Yu

*Attorney, Agent, or Firm*—Armstrong, Nikaido, Marmelstein, Kubovcik & Murray

[57] ABSTRACT

A spinning member, such as a top, and an impeller are employed together. The spinning member has a gripping section on an upper portion thereof, while the impeller imparts rotational movement to the spinning member when the spinning member is at rest and when the spinning member is rotating without substantially interrupting the rotation of the spinning member. The impeller includes a brush disposed on a rotatable portion of the impeller and cooperatively engageable with the gripping section of the spinning member for imparting rotational movement thereto, and a driver for supplying rotational movement to the brush.

14 Claims, 4 Drawing Sheets

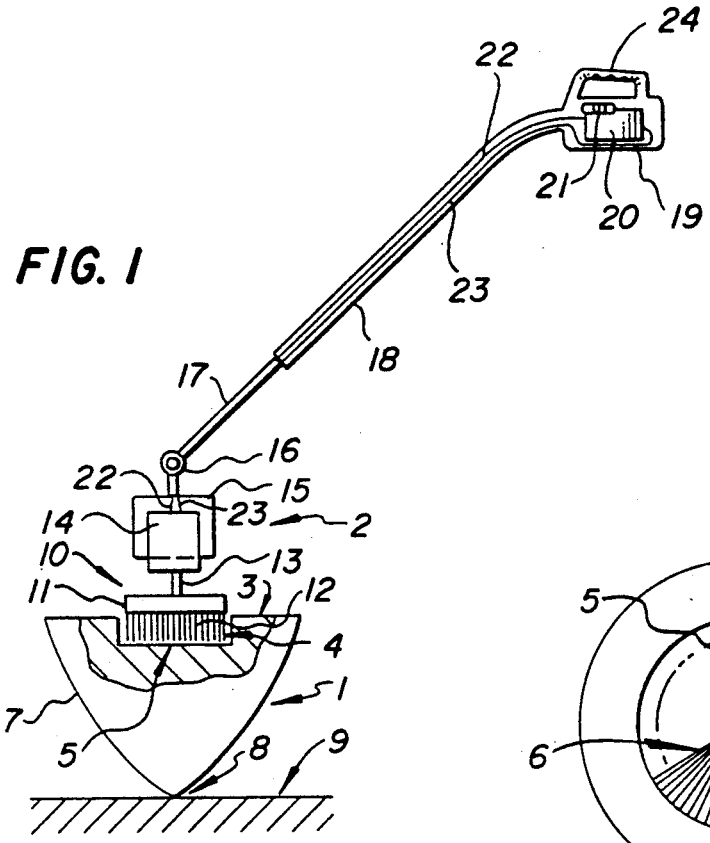
FIG. 1
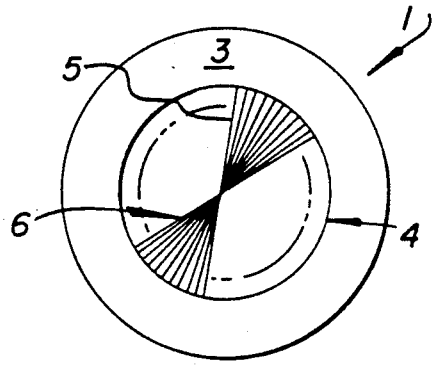
FIG. 2
FIG. 3
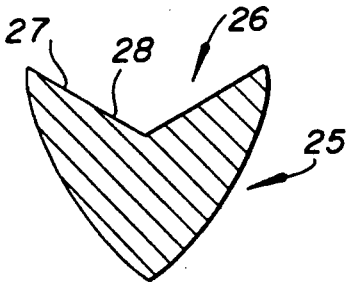
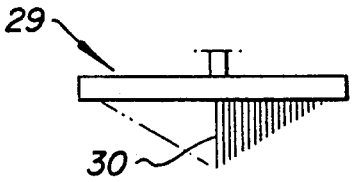
FIG. 4
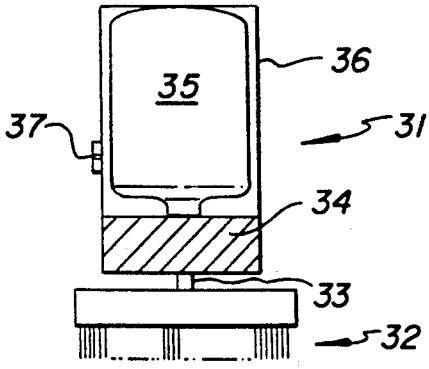
FIG. 5

FIG. 6
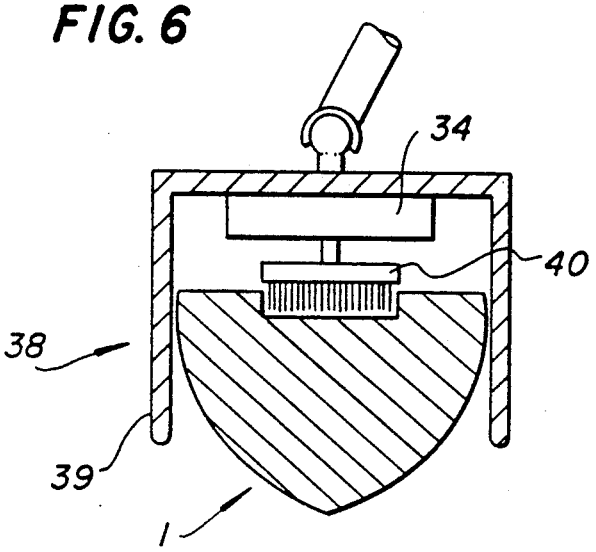
FIG. 7
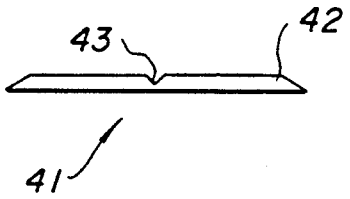
FIG. 9
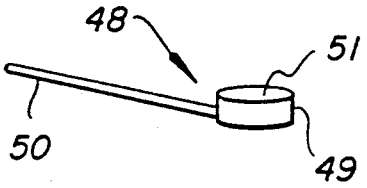
FIG. 8
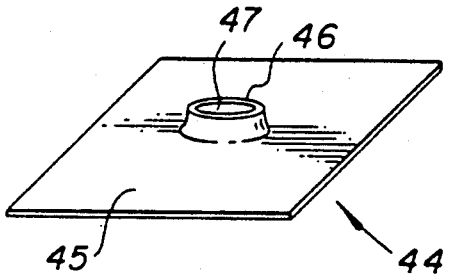
FIG. 10
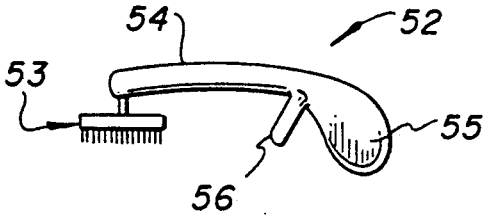
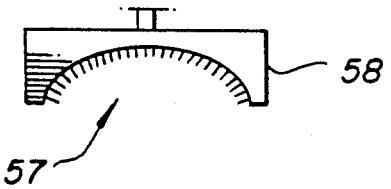
FIG. 11
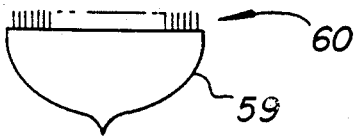
FIG. 12

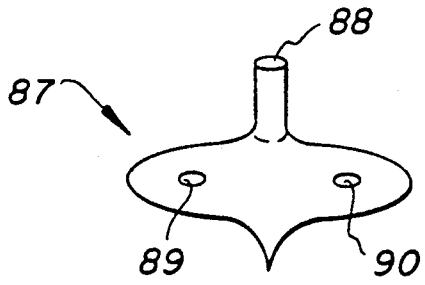
FIG. 19
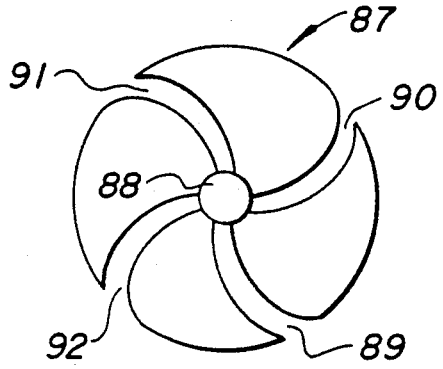
FIG. 20
FIG. 21
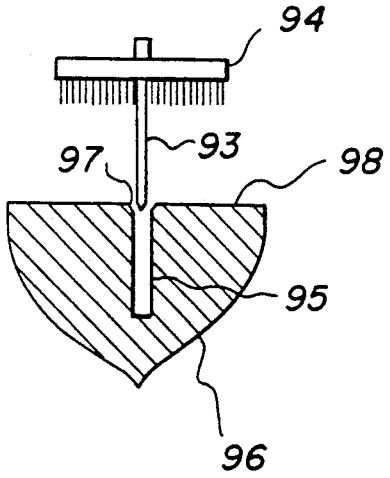
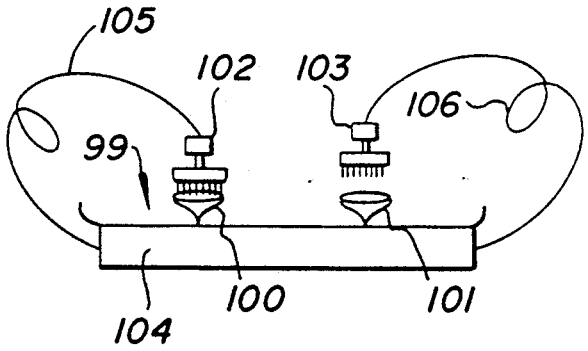
FIG. 22
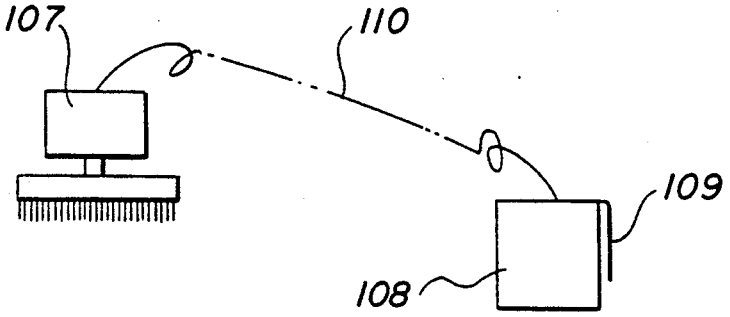
FIG. 23

TOP AND PROPELLING ELEMENT

BACKGROUND OF THE INVENTION

This invention relates to the field of rotating toys. More specifically, this invention relates to a spinning top or member and means or impeller for propelling it. The propelling means contains a rotatable portion which can be placed into frictional or mechanical contact with the top to start the top spinning and to maintain its spinning motion. The propelling means can be readily disengaged from the stationary or spinning top. The propelling means may be hand activated or may be powered by an electric motor.

Spinning tops of one kind or another have been known since ancient times, and have been used as a plaything and as a game device in virtually all cultures and countries. An extensive discussion of the multifaceted spinning top is provided by D. W. Gould in his treatise, "The Top: Universal Toy, Enduring Pastime" (Clarkson N. Potter, Inc./Publisher, New York, 1973; distributed by Crown Publishers, Inc.). That book provides a detailed treatment of the history, ethnology, archaeology and science of spinning tops. Tops have also been the subject of many U.S. and foreign patents.

In a general physics context, a top can refer to any spinning object; in the context of a toy, one of the most common forms of a top is in the general shape of a cone of circular cross-section that rotates about its axis of symmetry while it rests on its pointed tip.

Various means have been devised for starting the top to spin and for maintaining its spinning motion once the spinning has started. Perhaps the simplest way for initiating the spinning of a top is to hold it tightly between one's hands, with its tip pointing downwards. Then by rapidly moving one's hands in opposite directions in a generally horizontal motion, while pressing tightly against the side of the top, the top is released with a spinning motion which will maintain it spinning on the ground or other surface for some time. Some tops, typically smaller ones, may have a narrow shaft centrally projecting from their upper surface. This allows such tops to be spun by holding the shaft between one's thumb and middle finger with the tip of the top pointing downwards, and releasing the top with a spinning motion imparted to it from one's finger and thumb.

Another common way for initiating the spinning motion is by wrapping a segment of string around the body of the top, without tying the string to the top. The top is held in one's hand while the free end of the string is held tightly in the same hand. The top is then thrown swiftly away from one's body with its tip pointing downwards and while maintaining a tight grip on the string. The top must unwind from the string as it departs from the user, and is thereby forced to rotate about its axis of symmetry. The top retains this rotational momentum when it hits the ground and continues to spin for some time.

An alternative method for initiating the spinning motion is to releasably retain the properly oriented top in a special holder or launcher while the string is wrapped around the top. The string is pulled rapidly, thereby causing the top to rotate within the special holder; the spinning top is then released from its holder and continues to spin on its own.

Because of friction between the top and the air, and between the tip of the top and the surface upon which it is spinning, the spinning top will soon dissipate its kinetic energy, slow down, topple over and stop. However, if additional energy is supplied from an internal or an external source to compensate for the dissipative frictional losses of energy, the top can be maintained in spinning motion indefinitely. One of the classic methods for sustaining the rotational motion of a top is embodied in the so-called whipping top. In this device the top is whipped using a cord attached to the end of a stick. In the whipping process the string wraps around the body of the top and when the whip is retracted with a sudden jerk the rapid unwinding of the string imparts rotational momentum to the top. Continued whipping of the top sustains its rotational energy and can maintain the top's spinning motion indefinitely.

Other means for initiating the spinning of a top and/or for maintaining its rotational motion have also been devised. For example, La Falce, In U.S. Pat. No. 3,263,362, describes the use of an elongated arm attached to the end of a stick (the complete device being in the form of an inverted "T") with "resilient fingers" or spikes projecting from said arm. The top is stroked with the horizontal arm of this inverted "T" device wherein the projecting spikes engage with vertically disposed corrugations on the side of the top; this induces spinning of the top, or, if the top is already spinning, it helps to sustain that motion. Mordan in U.S. Pat. Nos. 2,393,796 and 2,449,405 describes air-propelled spinning tops. Another top driven by the release of a compressed material is described by Peabody in U.S. Pat. No. 2,721,418. A top containing electric motors mounted .therein and powered by an external power supply is described by Sheneman in U.S. Pat. No. 1,856,514. Brown, in U.S. Pat. No. 3,550,317, describes spinning top wherein the motor and the battery are mounted within the body of the top itself. Hellman, in U.S. Pat. No. 3,082,574, describes a top that is driven by a cable connected thereto at its upper central point, said cable being rotated by connection at its opposite end to an electrically driven motor. Endris, in U.S. Pat. No. 3,254,446, and Pawelka et al., in U.S. Pat. No. 3,224,142, describe means for initiating the spinning of a top by disengagingly attaching the top to a handheld spinning motor and dislodging the top from the motor when a high speed of rotation has been achieved. Both of the latter two patents incorporate embodiments that involve magnetic coupling between the top and the motorized unit. These devices, however, are not suitable for maintaining the spinning motion of the released top. Noda, in U.S. Pat. No, 3,623,262, describes another means for initiating the rotation of a top also by disengagingly connecting it to a motor driven unit. The motorized unit in this case also contains a rotating, or "energizing" disc that, after reversing its initial direction of rotation, can be used to drive the top by touching said energizing disc against the side of the spinning top.

Some of the tops described in the above-cited patents involve rather complicated electromechanical mechanisms. Some, such as U.S. Pat. No. 3,254,446 and U.S. Pat. No. 3,224,142, describe means for initiating the spinning motion but do not provide means for sustaining such spinning motion. Noda (U.S. Pat. No. 3,623,262) describes means for initiating the spinning motion, and also for sustaining the motion. However, that device, as presented in the patent, requires reversal of the direction of the spinning motor from its original direction of rotation in order to be used for maintaining the spinning motion of the top. The device of Noda involves contact between the side of the top and an oppositely rotating energizing disc. Such sideways contact can cause unwanted displacement of the top and obviates the ability to accurately control the position of the spinning top on its supporting surface. A commercially available (Sargent-Welch Scientific co., Skokie, Ill., 1987-88 Catalogue; Central Scientific Company, Franklin Park, Ill., 1987-88 Catalogue) device known as a "Gyrospinner" is used to rapidly impart high rotational speeds to gyroscopes. The gyrospinner consists of a motor-driven rotor which is contacted with the rim of the gyroscope wheel which is then forced to rotate in the opposite direction to that of the gyrospinner rotor. The device of Hellman (U.S. Pat. No. 3,082,574) allows the user to control the position of the spinning top, but this involves connecting the top to a hand-held cable.

Tops may be operated on the floor (indoors) or on the ground (outdoors). Alternatively, tops may be operated on a table or other special surface; in this latter case the tops are usually smaller. Tops may be played with in various ways, for example, a single individual may simply play with a top by maintaining it spinning. Alternatively, a group of children may take turns in "driving" a single top. Or a group of children may each play with separate tops to see who can maintain the top in operation for the longest duration, etc. A number of games are also based on the use of spinning tops; some of these games are described by D. W. Gould (cited above; see, for example, pp. 111-114) Sims et al. in U.S. Pat. No. 4,248,426 and Gross et al. in U.S. Pat. No. 4,256,306 describe games based on spinning tops. A game sold under the tradename "Turbo Tops" by Wham-O Manufacturing Co. (San Gabriel, Calif.) involves four players each with an air-propelled top on a special "plate", the objective being to see which top could knock over the opponent's top and stay in motion for the longest period. A game called Battling Tops(R) is marketed by View Master-Ideal Group, Inc. (Portland, Oreg.). In this game, which can involve two to four players and eight tops, the tops are launched by a mechanical means and collide in the special plate, or arena. The objective of the device is to see whose top wins the "battle". In both of these commercial games the tops are not energized following the initial release by the user.

SUMMARY OF THE INVENTION

The present invention involves a specifically designed top and a complementary energizing device; the energizing device or propelling means engages frictionally or mechanically or pneumatically with the top to initiate its spinning and to sustain the top's rotating motion once spinning has begun. The energizing device of the invention readily disengages from the spinning top. The top-cum-driving means is developed in such a manner that contact between the two components does not tend to topple the top nor to shift its position, unless the user specifically desires to do so, in which case the position of the spinning top can be accurately controlled by the user. The propelling means may be hand-driven or may be powered by a motor energized by a battery or by current from an electrical outlet.

The present invention is comprised of a spinning top and a detached means for causing the top to spin and for sustaining the spinning motion. The auxiliary means for spinning the top also allows the user to readily translate the top to any desired location on the supporting surface. This auxiliary device will be referred to hereinafter in this specification as a propelling means. In this specification, the word propel (propelling) embodies both the spinning motion of the top about its axis of symmetry and the translation of the top from one location to another.

One embodiment of the propelling means is comprised of a brush mounted on the shaft of an electrical motor. The rotating brush is brought into contact with the upper surface of the top, and by frictional engagement therewith it causes the top to spin; additional contact of the rotating brush with the spinning top sustains its rotational motion. In a alternative embodiment of the propelling means it is comprised of a centrifugal clutch mounted on the shaft of an electrical motor; when the shaft is rotating sufficiently rapidly, the clutch expands and engages with a receptive portion of the top which is then forced into a spinning motion. When power to the motor is turned off, the clutch disengages from the spinning top. Another embodiment of the invention involves a pneumatically propelled top wherein the compressed air for driving the top is generated by a turbine powered by a motor.

In order to facilitate the initiation of the spinning of the top, the top may be held loosely in its upright position while resting on the surface on which it is to spin during contact with the propelling means. Alternatively, the top may be initially mounted on a special support from which it can be displaced once it is spinning in a stable manner. Alternatively, the propelling means and top may be constructed in a complementary fashion so that they can mutually engage with one another in a manner that facilitates the initiation of spinning. For example, the upper surface of the top may contain a cylindrical cavity into which the clutch or the rotating brush or the compressed air delivery tube can freely fit and by means of which the clutch or rotating brush or airdelivery tube can help to maintain the top in its upright position before rotation of the top has begun or when it is spinning only slowly. Or the clutch or rotating brush or airdelivery tube may be surrounded by a stationary or rotating cylinder that extends below the level of the clutch or the brush or the air-delivery tube. Said cylinder would freely surround the upper part of the top and thereby help to maintain it in an upright position until it gains sufficient rotational speed to remain upright of its own accord. Both of the above-mentioned means of maintaining the non-spinning or slowly spinning top in an upright position (i.e. placing the clutch or the rotating brush or air-delivery tube within a cylindrical cavity in the upper part of the top, or surrounding the upper part of the top with a cylinder) also serve to translate the spinning top from one location to another. In the case of the modification involving the rotating brush, the top may have a roughened or corrugated surface in the region where it is contacted by the brush in order to enhance the frictional engagement therewith. In the present invention, the rotating part of the propelling means revolves about an axis that is substantially coaxial with the symmetry axis of the to during energy transfer from the propelling means to the top.

Major features of the invention are the simplicity of the device, ease of operation, facile engagement and disengagement between the propelling means and tee top, ability to both start the top spinning and to maintain its spinning motion, ability to translate the spinning top, and inexpensiveness of materials, components, and construction of the device.

In accordance with the above-presented summary of the invention, and a further description of the invention which will follow, it is the primary object of this invention to provide a spinning top and a means for propelling said top.

Another object of this invention is to present a simple means for initiating the spinning of a top.

Another object of this invention is to provide a simple means for maintaining the spinning motion of a top.

Another object of this invention is to provide a top in combination with a rotating brush or like means wherein the rotating brush or like means can start the top spinning and maintain the top in a spinning motion.

Another object of this invention is to provide a top in combination with a detached, rotatable, centrifugal clutch which can engage with said top and impart rotational energy thereto.

Still another object of this invention is to provide a means for propelling a top wherein such means can be readily engaged with, and disengaged from, the top.

Yet another object of this invention is to provide a facile means for moving a spinning top from one location to another in a controlled manner.

Another object of this invention is to provide a means for propelling a top based on frictional and/or mechanical contact between the top and a user-controlled rotating device.

Another object of this invention is to provide a means for spinning a top that can be readily operated by young children.

Still another object of this invention is to present a top which may be spun on the floor, ground, on a table or other surface.

Yet another object of this invention is to provide a motor propelled top which is advantageous for battling corresponding tops of opposing players.

Another object of this invention is to provide a top-cumpropelling means that is particularly advantageous for playing games with, especially table-top games, due to the facile and gentle manner by which the rotation of said top can be sustained indefinitely.

Another object of this invention is to provide a pneumatically driven spinning top where the spinning motion is both started and sustained by a supply of compressed air from a turbine.

These and other objects and advantages of the present invention will become apparent to those skilled in the art upon reading the details of construction and use as more fully set forth below, reference being made to the accompanying drawings forming a part hereof wherein like numerals refer to like parts throughout.

BRIEF DESCRIPTION OF THE DRAWINGS

FIG. 1 shows one embodiment of the invention including the spinning top and propelling means;

FIG. 2 shows a top view of the spinning top of FIG. 1;

FIG. 3 is a cross-sectional view of another embodiment of the spinning top of the present invention;

FIG. 4 shows another embodiment of the brush of the propelling means of the present invention;

FIG. 5 shows another embodiment of the propelling means of the present invention;

FIG. 6 shows another embodiment of the propelling means of the present invention;

FIG. 7 shows one embodiment of a holding means for the stationary or slowly spinning top;

FIG. 8 shows another embodiment of a holding means for the top;

FIG. 9 shows another embodiment of a holding means for the top;

FIG. 10 shows another embodiment of the propelling means of the present invention;

FIG. 11 shows another embodiment of the brush of the present invention;

FIG. 12 shows another embodiment of the spinning top of the present invention;

FIG. 19 shows a side view of a modification of a spinning top that is energized by compressed air;

FIG. 20 shows a top view of the air-propelled top of FIG. 19;

FIG. 21 shows another embodiment of the top-cum-propelling means of the present invention:

FIG. 22 shows a side view of one embodiment of an arena for spinning tops; and FIG. 23 shows a propelling means energized by a power-pack that may be contained on one's person.

DETAILED DESCRIPTION OF THE PREFERRED EMBODIMENTS

Figure 13:
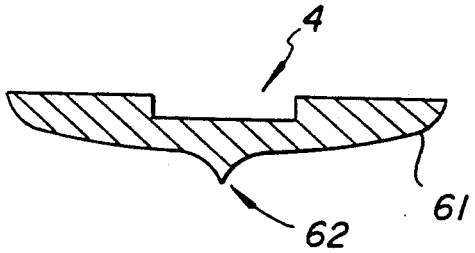
FIG. 13 is a cross-sectional view of a further embodiment of the spinning top of the present invention.

Before the present invention is described in detail in terms of its preferred embodiments, it is to be understood that this invention is not limited to the particular arrangement of parts shown, as such devices may, of course, vary. It is also to be understood that the terminology used herein is for the purpose of describing particular embodiments only, and is not intended to be limiting.

In the following discussion, the embodiments involving a rotating brush or a brush-type device will be addressed first; following that, the embodiments involving a centrifugal clutch will be considered, and then the air propelled top will be discussed.

FIG. 1 shows one embodiment of the present invention incorporating a top generally represented by the numeral 1 and a propelling means generally designated by the numeral 2. The top 1 has an upper surface 3 that has a depressed region 4 therein. The bottom 5 of the depressed region 4 may have a roughened surface or may have radially disposed projections or recessions 6 therein, as illustrated in FIG. 2 or is otherwise adapted to engage frictionally with the rotating brush. The top 1 may have an outer wall 7 and a tip 8 which rests on a surface 9. The propelling means 2 consists of a brush 10 having a stock 11 to which are attached the bristles 12. The brush 10 is connected to a shaft 13 of a motor 14 that is mounted in a housing 15. The housing 15 is connected by means of a ball-and-socket joint 16 or by some other means to a tubular rod 17. The joint 16 allows the angle which the brush subtends to the ground to be adjusted by the user. Tubular rod 17 is telescopically mounted inside another tubular rod 18.

The telescoping feature of the handle is beneficial in allowing the user to adjust the length of the device to accommodate his/her height; however, some embodiments of the invention may not include this adjustable feature.

At the end of the hollow rod 18 opposite its connection to rod 17 is a battery holder 19 containing one or more batteries 20. Mounted on the outside of battery holder 19 is a three-way switch 21 for turning the power ON and OFF, with the option of reversing the polarity of the voltage in the ON-mode. The power is transmitted from the battery 20 via the switch 21 and the wires 22 and 23 to the motor 14. A handle 24 may be used for holding the propelling means 2.

FIG. 3 shows an alternative embodiment of the spinning top 25 wherein the depressed region 26 in the upper surface of the top is essentially conical in shape. The inner wall 27 of top 26 may be roughened or may have projections or recessions 28 therein, or is otherwise adapted to frictionally engage with the rotating brush. FIG. 4 shows an embodiment of a brush 29 that may be particularly useful for propelling the top 25 of FIG. 3. The bristles 30 in brush 29 are arranged in an essentially conical form to engage with the conical cavity of the top 25 in a self-centering manner. Such self-centering of the propelling means was found to be an advantageous and desirable feature of the present invention. Alternatively, instead of the top as shown in FIG. 3 with a conical cavity, the upper part of the top may be in the form of a cone with its point oriented upwards; correspondingly, the brush would then be in the from of a hollow cone that would fit like a cap over the upper part of the top.

FIG. 5 shows an embodiment of the propelling means 31 consisting of a brush 32 connected by means of a shaft 33 to a motor 34 powered by battery 35 mounted in a housing 36. The power to the motor 34 is controlled by the switch 37. In this case the propelling means 31 is held by the user holding the housing 36 in his/her hand.

The propelling means 31 illustrated in FIG. 5 is especially suitable for driving a top on a table or other such surface whereas the propelling means 2 of FIG. 1 is particularly suitable for driving a top on the floor or ground.

FIG. 6 shows another embodiment of the propelling means 38 wherein a cylinder 39 surrounds, in part, the body of the top 1. The rotatable brush 40 is centrally mounted inside the nonrotatable cylinder 39. In other embodiments of this device, the cylinder that surrounds the top may be rotatable with the brush. The cylinder serves to maintain the stationary, or slowly rotating, top in an upright position. The cylinder 39 is preferably transparent so that the top can be seen by the user when encircled by this cylinder.

FIGS. 7, 8 and 9 show embodiments of devices for holding the top in an upright manner during the initiation of its spinning and while it is spinning slowly. The holding means, 41, in FIG. 7 consists of a support 42 having a depression 43 into which the tip 8 of the top 1 can be fit for the purpose of holding the top 1 in an upright position. FIG. 8 shows an embodiment of the holding device 44 consisting of a flat portion 45 having a hollow cylinder 46 located thereon. The tip 8 of top 1 is inserted into the hole 47 of cylinder 46 for the purpose of holding the top 1 upright. FIG. 9 shows another embodiment of the holding means 48 consisting of a cylinder 49 and a handle 50 which is held by the user in the hand opposite to that used for holding the propelling means. The tip 8 of the top 1 is mounted in the cavity 51 to maintain the stationary or slowly rotating top in an essentially upright position.

The propelling means discussed above (FIGS. 1, 5 and 6) are all driven by an electric motor. Alternatively, the brush may be spun by means of a hand powered device. For example, FIG. 10 shows a gun-shaped device 52 having a brush 53 attached to the end of its "barrel" 54. The handle 55 is held in one's hand and, by pulling the trigger 56 the brush 53 can be rotated. The device 52 has an internal mechanism comprising gears, or pulleys, or shafts for converting the compression energy from one's hand into rotational energy of the brush 53. The device 52 may also have a flywheel to facilitate its operation.

The top-cum-propelling means of the present invention is operated as follows: The brush 10 of propelling means 2 (FIG. 1) is positioned inside the hollow depression 4 of the top 1 and the top 1 is held with its central axis substantially vertical and with its tip 8 on a surface 9. The motor 14 is started by putting switch 21 into the ON position and this causes the brush 10 to spin rapidly. The bristles 12 of brush 10 engage frictionally with the projections or recessions 6 of the surface 5, or with the roughened surface of face 5; this causes the top 1 to rotate in the same direction as the brush (all rotations in this specification being viewed by looking down on the device from above). When the top 1 is spinning sufficiently rapidly, the brush 10 can be removed from the hollow region 4 of top 1, and the top 1 continues to spin. By successively reinserting the rotating brush into the hollow region 4 of top 1 and contacting the bristles 12 with surface 5, the top is repetitively re-energized and can maintain spinning in this manner indefinitely. By moving the spinning brush 10 horizontally while it is engaged with the top 1 the top 1 can be readily maneuvered to different locations on surface 9. The direction of rotation of top 1 can be controlled by the position of switch 21.

A feature of the present invention is that the axis of rotation of the propelling means (i.e. shaft 13) is essentially coaxial with the axis of rotation of the top during energy transfer from the propelling means to the top; consequently, the top is forced to rotate in the same direction as the revolving brush. The embodiment of the top 25 shown in FIG. 3 and the embodiment of the brush 29 shown in FIG. 4 facilitate the centering of the brush 29 in the hollow region 26 of top 25 because the conically shaped cavity 26 in top 2 symmetrically accommodates the conically distributed bristles 30 on brush 29. The inventor has found that the conical-shaped cavity 26 a shown in FIG. 3 is also quite effective in centering a brush of the general shape shown by 10 in FIG. 1. The propelling means 2 of FIG. 1 may be held by the user at handle 24 and the length of the device may be adjusted to accommodate users of different heights by means of the telescoping section in which section 17 slides into or out of section 18. The telescoping section may be locked in the desired position by conventional means such as, for example, by friction or by a tightening screw. Until the user has gained a little practice in using the propelling means 2 of FIG. 1, it is desirable to use both hands to hold the propelling means.

The embodiment of the propelling means 31 shown in FIG. 5 where the housing 36 is held directly in the user's hand is particularly convenient when the top is to be spun on a table or other such surface; this propelling means is easier to use than that shown in FIG. 1.

In the embodiment of the propelling means 38 shown in FIG. 6, the cylindrical shell 39 surrounds part of top 1 and thereby serves to maintain the top 1 in an upright position during initiation of its spinning.

The devices depicted in FIG. 7, 8 and 9 show means for holding the top in an upright position when the top is being started. The top is set into the cavity while it is stationary and is then rotated by the revolving brush. The platform 45 in FIG. 8 adds extra stability to the top-supporting cylinder 46. The handle 50 in FIG. 9 is held in the user's hand and prevents the cylinder 49 from being tossed aside by reaction from the spinning top.

The brush in the present invention may be driven by an electric motor. Alternatively, as illustrated in FIG. 10, the brush may be hand-propelled by pulling trigger 56 on gunlike device 52. The internal mechanism on device 52 can be conventional.

Another embodiment of the propelling brush is shown in FIG. 11, where the bristles 57 are mounted on the inner wall of a cap-shaped device 58 that loosely encircles the upper part of a top. As shown in FIG. 11, the bristles may not all be parallel to each other.

FIG. 12 shows an embodiment of a top 59 which has bristles 60 attached to its upper surface; in this case the top 59 is propelled by contact between the bristles 60 and the bristles or other surface on the rotating brush of the propelling means. In this case, the "brush" of the propelling means may be devoid of bristles and may simply have a surface that engages frictionally with the bristles 60 on top 59

FIG. 13 shows a.design of top 61 that is very readily started by contact with the propelling means of the present invention. Top 61 is more flat and discus-like in shape and is readily started spinning on its tip 62 when contacted with the revolving brush without any additional help from the user and without the need for any of the auxiliary devices illustrated in FIGS. 7, 8 and 9.

Figure 14:
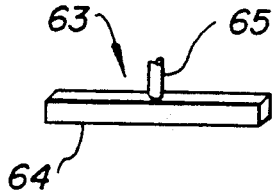
FIG. 14 shows an alternative embodiment of a brush-type device of the present invention.
Figure 15:
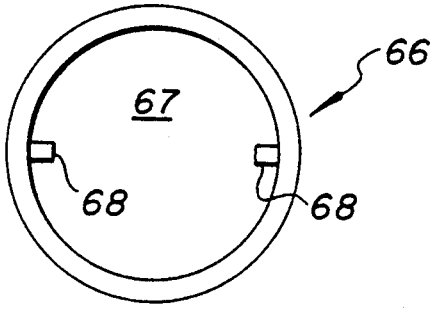
FIG. 15 shows an embodiment of the spinning top for use in association with the device of FIG. 14.

The meaning of the word "brush" in the context of the present specification is broad and is intended to embrace not only a bristle-containing object, but any such device capable of engaging frictionally or otherwise with the top such as a rubber pad, felt pad, plastic pad, wood pad, cloth pad or any other resilient or non-resilient means. For example, the brush may consist of the section 11 (FIG. 1) without having any bristles attached; in this case, the top is driven by frictional contact between the element 11 and the top 1. Or, instead of bristles, the brush may have small rubber spikes or teeth for frictionally engaging with the top. In FIG. 14 an impeller 63 consists of an elongated rod, or bar 64 mounted on shaft 65. FIG. 15 shows a top view of top 66 for use association with impeller 63; top 66 has a hollow region 67 with two or more projections 68 which engage with the spinning bar 64 of impeller 63 and which can also be readily disengaged therefrom. In this case, the interaction between the brush and the top is more of a "pushing" reaction than a frictional engagement, and such interactions are considered to be within the domain of this patent. It has also been found that a plurality of projections 68 as shown in FIG. 15 can be beneficial in association with a bristle-containing brush such as that shown in FIGS. 1 and 5.

Figure 16:
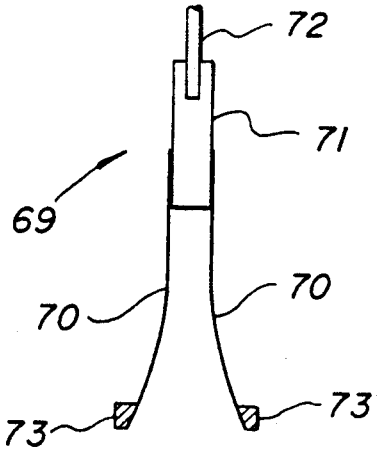
FIG. 16 shows one embodiment of a centrifugal clutch for use in the present invention.
Figure 17:
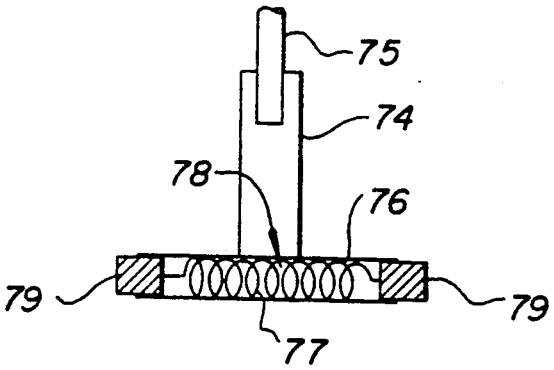
FIG. 17 shows another embodiment of a centrifugal clutch of the present invention.

When the brush 10 is rotated at a very rapid rate, the bristles 12 bend outwards radially due to centrifugal force; in this case the bristles can engage with the side-walls of cavity 4 in top 1. Based on this concept, another modification of the brush of the present invention is illustrated o FIG. 16. The brush 69 in FIG. 16 is essentially a centrifugal clutch consisting of two or more legs 70 attached to a base 71 which, in turn, is attached to the shaft 72 of the propelling motor. Attached to the lower ends of legs 70 are pads 73. The pads 73 are positioned within the cavity 4 of top 1; when the motor is turned on, the rotating pads 73 move outwards from each other by centrifugal force and engage with the inner walls of cavity 4 in top 1, thereby causing the top 1 to rotate in the same direction as the motor. When the power to the motor is turned off the legs 70 and attached pads 73 stop rotating and the pads retract to their former position due to the spring action of legs 70, and thereby disengage from the top 1. The centrifugal clutch 69 can be readily engaged with and disengaged from the top by starting and stopping the motor. The centrifugal clutch of this invention may take many other forms such as that shown in FIG. 17, consisting of a shaft 74 attached to axle 75 of the motor; a tubular section 76 contains a spring 77 that is anchored at point 78 to the tubular section 76; pads 79 are attached to opposite ends of spring 77. When the device of FIG. 17 is rotated, the pads 79 move outwards due to centrifugal force and can engage with the inner walls of the cavity 4 of a top 1 and thus cause it to spin. The pads 73 of FIG. 16 and pads 79 of FIG. 17 can be made from any suitable resilient or nonresilient material, such as rubber, felt, wood, plastic, metal, cloth, etc. When used in association with the centrifugal clutch of FIGS. 16 or 17, the inner walls of cavity 4 in top 1 are fabricated to engage efficiently with the pads 73 or 79 of the centrifugal clutch.

Figure 18:
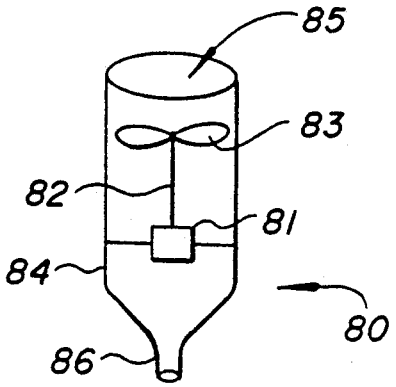
FIG. 18 shows an embodiment of the propelling means consisting of a motor-driven air compressor.

FIG. 18 shows an embodiment of the propelling means 80 consisting of a motor 81 with its shaft 82 connected to a propeller 83, all of these units being contained within a tubular housing 84. The propeller 83 is rotated in a direction that draws air into the tubular housing 84 at its wide end 85 and expels the compressed air at its narrow end 86. The motor is powered by a battery (not shown) or from the mains. FIG. 19 shows a side view of a top 87 that is to be air-propelled. Compressed air is injected into the cavity 88 and exits from tangentially disposed exit ports, two of which, 89 and 90, are shown in FIG. 19. FIG. 20 shows a top view of the compressed air-driven top of FIG. 19, showing the tangentially disposed exit ports 89, 90, 91 and 92. When the compressed air that enters through the cavity 88 exits through the ports 89, 90, 91 and 92, the top as illustrated in FIG. 20, is forced to rotate in a clockwise manner. Other embodiments of the air compression means may also be used. A "central" air compressor with multiple manifolds to which a set of flexible tubes is attached may also be used; in this case, each player uses one of these tubes as a source of compressed air to drive his/her top. In other embodiments, the top of FIGS. 19 and 20 may have the section 88 in the shape of a funnel with the wider end facing upwards to facilitate its engagement with the compressed air source.

Another way for centering the brush on the spinning top is illustrated in FIG. 21 wherein the pin 93 is centrally located on brush 94. The pin 93 fits comfortably into the channel 95 in top 96. The channel 95 has a wider conical section 97 close to the upper surface 98 of this top; this wider section 97 facilitates the entry of pin 93 into channel 95. Use of the pin 93 helps to stabilize the top when starting its spinning motion and it also serves to center the rotating brush on the top both during the initiation of its motion and while sustaining the spinning motion of the top.

The top of the present invention may be played on the floor or on a table or on some other such surface indoors, or may be played on the ground outdoors. In either location, the top may be played on its own or in association with the tops of other players where the tops are forced to collide with each other in a battle game. The ability to drive the tops by repetitive contact with the revolving brush or centrifugal clutch or compressed air and the ability to translate the tops along the playing surface is a favorable feature of the present invention in the context of such top battles. The device of the present invention may also be equipped with a special arena within which the game is played for either the table-top or floor/ground versions of the game.

FIG. 22 shows a side view of an arena 99 for playing with tops 100 and 101. In this case the propelling means 102 and 103 are both powered from a single, central power unit 104 by means of cables 105 and 106. In other modifications the propelling means 107 may be powered by power-pack 108 that is held in one's pocket or clipped to one's belt or other clothing by means of a clip 109, as shown in FIG. 23. The propelling means is connected to the power-pack by an electrical cable 110.

The top of the present invention may be made from wood, metal, plastic, rubber or other suitable material, or from a combination or composite of such materials. The body of the propelling means may be made from similar materials. Many other embodiments of the device can be made which are within the scope of the present invention, for example, instead of the motor being battery-driven, it may be powered from a mains outlet. In addition, the walls of the propelling means may be constructed in part of electrically conducting material and this may serve to conduct the current from the power source to the motor. In addition, the cylinder 39 (FIG. 6) may be movable or removable relative to the brush 40 so that it can be retracted out of the area of the brush or removed completely once the top is spinning so as to facilitate subsequent contact between the brush 40 and the top 1.

The propelling means of the present invention may be used for initiating the spinning of, and for maintaining the spinning of, other objects besides tops. Instead of, or in addition to, the three-way switch 21 shown in FIG. 1, the handle 24 may contain a press button switch normally maintained in the OFF position by means of a spring; the user presses the switch to drive the motor and releases the switch in the intervals between the propelling action. This helps to conserve power and also ensures that the motor is automatically turned off when the device is left down, thereby prolonging the battery life. Other types of switches may also be used in the present invention.

The brush on the propelling means may be replaceable in order to substitute a new brush for an old one or to use variously shaped brushes corresponding to variously shaped an variously sized tops. For a top of a given weight, it is best to have the mass concentrated near the outer edge of the top this increases the rotational energy for a given angular velocity of the top and thereby increases the stability of the spinning top and causes it to spin for a longer period. Other features of the top could include a sound-making means and an internal centrifugal switch that lights a bulb from an internal battery when a sufficient angular velocity is attained.

The bristles of the brush may be mounted at various angles with respect to the axis of the motor instead of being exactly parallel thereto. Furthermore, the top does not necessarily have to have a depression 4 even in the absence of encircling cylinder 39; in such a case the rotating brush engages frictionally with the upper surface of the top.

In addition to the circular tops illustrated in this specification, the outer walls of the top may be noncircular in cross-section or may have projecting segments thereon to facilitate their impact with other spinning tops in battles. The tops should be constructed from shatter-proof material, particularly if they are to be used for battling, they should be devoid of sharp edges and they should also be able to withstand the considerable centrifugal forces that are produced at the large angular velocities that can be achieved with this device.

The cross-section of the rotating brush is preferably circular to minimize any abrupt contact with the user's fingers, to facilitate uniform contact with the top and to minimize atmospheric friction. However, rectangular and other cross-sectional shapes for the brush also work very well. The torque generated by the motor should be sufficiently small that the rotation of the brush is readily stopped by contact with the user's fingers for safety reasons.

Instead of using a motor to generate compressed air, other sources of compressed air may be used in association with the top of the present invention; for example, compressed air may be produced by squeezing a rubber bulb, or an auxiliary tank of compressed air may be used.

The instant invention is shown and described in what are considered the most practical and preferred embodiments. It is recognized, however, that departures may be made therefrom which are within the scope of this invention and that obvious modifications will occur to one skilled in the art upon reading this disclosure.

I claim:

1. A toy spinning top system, comprising:

a spinning top having a first gripping section on an upper portion thereof; and a movable impelling means for imparting rotational motion to said spinning top when said spinning top is at rest and when said spinning top is rotating without substantially interrupting the rotation of the spinning top, and for imparting translational motion to said top along a surface on which the top is spinning, wherein said impelling means includes a rotatable second gripping section cooperatively engageable with said first gripping section of said spinning top, such that said cooperative engagement between said gripping sections causes rotating motion and translational motion to be transmitted from said impelling means to said spinning top in response to rotation and movement of said impelling means, said impelling means having a drive means for rotating said second gripping section, wherein one of said first and second gripping sections has a brush-like member having a plurality of bristles cooperatively engageable with the other of said gripping sections in a substantially co-axial manner.

2. The toy spinning top system of claim 1, wherein said brush-like member having the plurality of bristles is disposed on said second gripping section.

3. The toy spinning top system of claim 2, wherein said first gripping section comprises a centrally located depressed portion cooperatively engageable with said brush-like member.

4. The toy spinning top system of claim 3, wherein said depressed portion includes a frictional surface on the bottom thereof for increased frictional engagement with said brush-like member.

5. The spinning member and impeller of claim 4, wherein said frictional surface includes radially extending projections and recessions.

6. The spinning member and impeller of claim 3, wherein said depressed portion includes a peripheral wall engageable with said brush-like member.

7. The toy spinning top system of claim 2, wherein said first gripping section has a depressed cone shape and said brush-like member of said second gripping section has a corresponding extending cone shape.

8. The toy spinning top system of claim 2, wherein said brush-like member has a concave surface engageble with said first gripping section of said spinning top.

9. The toy spinning top system of claim 1, wherein said impelling means includes a cylinder surrounding said brush-like member and for surrounding said spinning top when imparting rotational and translational movement thereto.

10. The top spinning top system of claim 1, wherein said drive means includes an electric motor.

11. The top spinning top system of claim 10, wherein said drive means also includes a handle separated from said electric motor by an adjustable extension rod.

12. The top spinning top system of claim 10, wherein said electric motor is battery powered.

13. The top spinning top system of claim 12, wherein the battery for said motor is remote from said motor and connected thereto by electrical wire.

14. The top spinning top system of claim 1, wherein said drive means is hand propelled.

* * * * *